United States Patent [19]

Seitz, Jr.

[11] Patent Number: 4,993,078

[45] Date of Patent: Feb. 19, 1991

[54] SHIRT CONVERTIBLE TO HEADDRESS

[76] Inventor: William E. Seitz, Jr., 2358 Kelly St., Ramona, Calif. 92065

[21] Appl. No.: 442,506

[22] Filed: Nov. 28, 1989

[51] Int. Cl.[5] ..... A41B 1/00

[52] U.S. Cl. ..... 2/115; 2/DIG. 6

[58] Field of Search ..... 2/115, DIG. 6, 46, 174, 2/207, 106, 209.1

[56] References Cited

U.S. PATENT DOCUMENTS 4,697,362 10/1987 Wasserman ..... 2/DIG. 6

4,710,981 12/1987 Sanchez ..... 2/115

*Primary Examiner*—Allan N. Shoap

*Assistant Examiner*—Daniel G. DePumpo

*Attorney, Agent, or Firm*—John J. Murphey

[57] ABSTRACT

An improved modification to a typical T-shirt, to convert it into a full headdress, by adding first and second strips of releasable, press-together bonding material, such as Velcro (trademark) in spaced-apart relation on one the shirt torso panels near the panel-sleeve seam, one set above the other, so that when the top of the shirt is folded downward, one-half the depth of the sleeves, to place the first strip on one side of the shirt and the second strip on the other side of the shirt, and the torso-covering panels draped over the wearer's head and down over the rear of the wearer's neck, the folded sleeves may be wrapped rearward about the head and brought into overlapping contact along the strips to form the headdress.

16 Claims, 4 Drawing Sheets

SHIRT CONVERTIBLE TO HEADDRESS

BACKGROUND OF THE INVENTION

1. Field of the Invention

This invention relates to the field of wearing apparel. More particularly, this invention relates to the field of shirts, particularly pull-over shirts such as T-shirts, and a novel modification thereto for permitting the shirt to be converted to a usable headdress.

2. Description of the Prior Art

Pull-over shirts are generally of the type having front and rear torso-covering panels joined together along their respective sides and top, a pair of sleeves attached at seams to the panels near the shoulder area and a collar band secured about a head opening so that one putting on the shirt pulls it over their head and extends their arms through the respective sleeves and the torso-covering panels are then pulled down over the torso. Where the shirt has short sleeves, it is generally known as a "T-shirt".

It is a fact that many people wear these pull-over shirts, including T-shirts, when they are outdoors. There are numerous instances where, when a person starts to wear a T-shirt, either the heat of the day or the energy expended by the individual in playing or working makes such wearing of the shirt uncomfortable, but at the same time the heat of the sun makes it desirable to have a headdress of sorts to shade one from the effects of the sunlight. Heretofore, there has been little in the way of means for removing one's shirt and using it as a headdress.

U.S. Pat. No. 4,392,258 concerns such a pull-over shirt wherein a semi-stiff bill is placed inside the shirt at the rear of the neck opening that can later be used as a bill in front and above the eyes serving as an eye shade when the shirt is used as an open headdress and worn over the head. However, such utilization has not been widely achieved primarily because the sleeves, either long or short, are necessarily draped down over the sides of the head and pose annoying dangling material to interrupt the person's peripheral vision and sometimes, when the head is twisted quickly in looking from side to side, the sleeves bang against the face in an uncomfortable manner. Further, the placement of the sun visor requires the collar band to be placed low on the head thus exposing the top of the head to the sun. Where the shirt has long sleeves, they may be tied in a knot behind the head; however, where the shirt is built along the lines of the popular short sleeve T-shirt, such tying of the arms is not possible. Moreover, tying sleeves of the shirt together places unnecessary stress on the fibers making up the threads and can damage the lay of the shirt and thereafter to create unsightly bulges and pulls in the shirt sleeves.

In addition, it is desirable in many instances for a person to have his or her name prominently displayed on a portion of their shirt or have some sort of advertising placed thereon, such as the trademark placed there by the manufacturer or marketer. Often, such names and trademarks may only be silk-screened onto the shirt and such will fade and become worn after frequent use and/or washing to slowly disappear and thereby be rendered useless as the shirt gets older with use. There are, however, particular manners of placing names and/or trademarks on certain material that will withstand significant handling and washing cycles without deterioration thereby being a longer-lasting and more desirable vehicle for display of such information. Unfortunately, most T-shirt material is not capable of this sort of display without particular and costly means being used thereon.

There appears, therefore, a clear need for a method of transforming the ordinary T-shirt into a headdress that will protect the head and most desirably, the rear or back of the neck from the harmful effects of extended exposure to the sun, and at the same time, having means on or in connection with the shirt for placing one's name or trademark prominently thereon without suffering the consequences of deterioration through extended washings and use. Even further is the need for a shirt convertible to a headdress without the potential for causing the shirt to be rendered baggy and unkempt due to the intertying of long sleeves.

SUMMARY OF THE INVENTION

This invention is a unique pull-over shirt, most desirably a T-shirt, but capable of other designs, that is easily and quickly convertible to a very effective headdress for covering all of the upper part of the head as well as the back of the neck, without the attendant difficulties hereinbefore described. This novel combination is achieved by the unique placement of first and second strips of releasable, pressed-together bonding material to select portions of the shirt that will be able to be interconnected to form the headdress when the shirt is placed over the head and the sleeves placed in over-lapping contact about the head.

The uniqueness of the shirt is demonstrated by the fact that none of the sleeves or other portions of the shirt need be tied together or otherwise stressfully engaged so as to relieve the shirt of its potential for damaging and bagging due to intertying of the sleeves. Further, the shirt is easily and readily useful in a wide variety of sizes as well as with long sleeves and short sleeves to provide a headdress displaying all of the aforesaid advantages. Even further, the placement of strips of releasable, pressed-together bonding material may be uniquely arranged to contain one's name, trademark or other indicia, that will thereafter be displayed and carried on the shirt in a long-lasting presentation not affected by extended wear and numerous washing cycles as experienced in those designs in the prior art.

Accordingly, the main object of this invention is a pull-over shirt preferably of the T-shirt variety, that is easily and conveniently converted to a headdress for total coverage of the head and the back of the wearer's neck. Other objects of the invention include a shirt convertible to a headdress that does not require intertying of the sleeves thereby removing the possibility of damage to the shirt; a shirt that is convertible to cover the whole head of the wearer and the back of the neck as opposed to only the partial coverage hereinbefore experienced in the prior art; a T-shirt convertible to a headdress that may be obtained through a wide variety of sizes of shirts, both long sleeve and short sleeve; and a means of easily retrofitting existing T-shirts into the desirable combination for later convertibility to the headdress. Further objects include a shirt upon which a person's name, trademark or other indicia may be prominently displayed in a manner that is not susceptible to the normal deterioration occasioned by silk-screened shirts upon extended wear and washing cycles; and a headdress that provides comfort to the wearer, protects from the harmful rays of the sun and adjusts easily to fit different size heads.

These and other objects of the invention may be obtained by reading the following description of the preferred embodiment taken together with the drawings appended hereto. The protection sought by the inventor may be gleaned from a fair reading of the claims that append this specification.

DESCRIPTION OF THE PREFERRED EMBODIMENT

Figure 1:
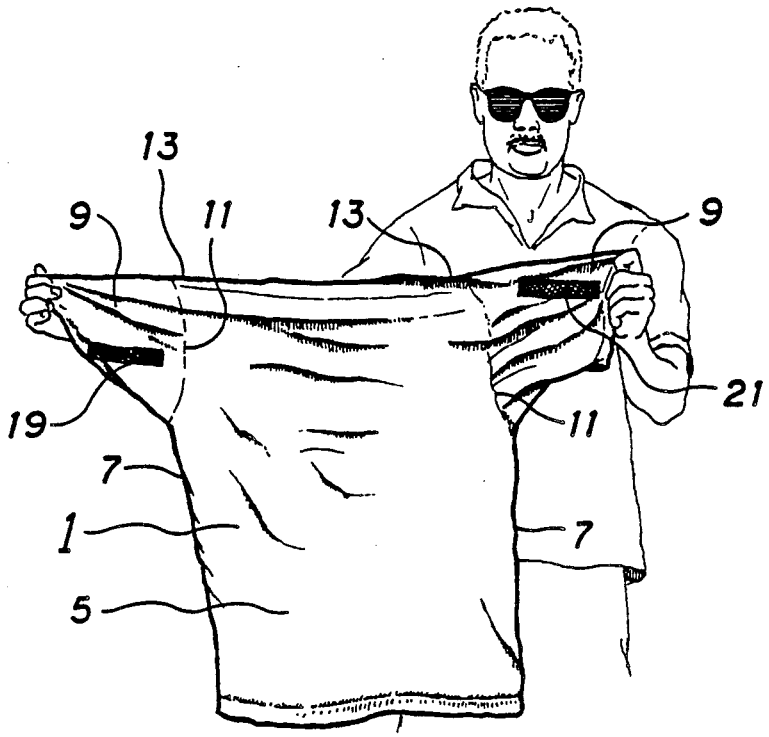
FIG. 1 is a back or rear elevational view of a typical T-shirt showing the unique placement of the releasable, press-together bonding strips of this invention.
Figure 2:
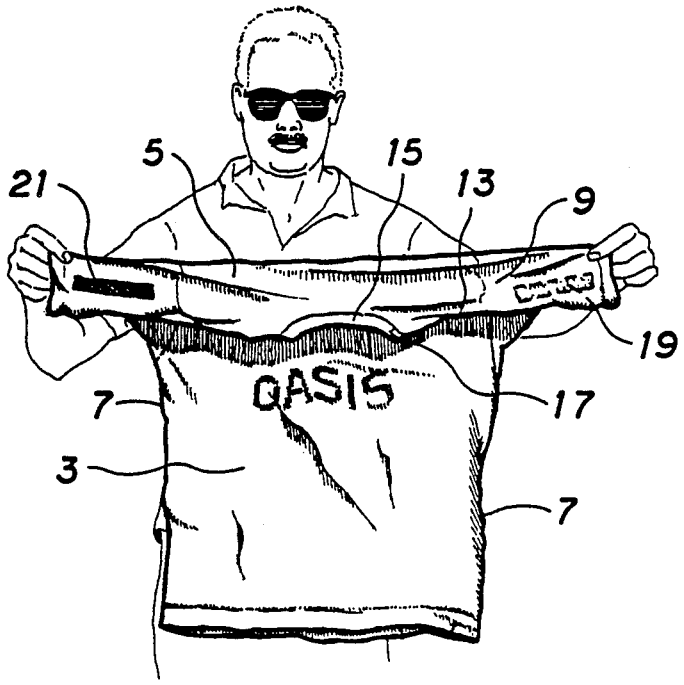
FIG. 2 is a front elevational view of the T-shirt with the top folded forward, the first step in a series of steps, shown in FIGS. 2 through 5, in converting the T-shirt of this invention to the unique full headdress.

As shown in FIGS. 1 and 2, this invention involves a shirt 1 of the type comprising front and rear shoulder and torso-covering panels 3 and 5 respectively, joined together at seam 6 formed along their respective side edges 7, and further attached to a pair of spaced apart sleeves 9, each sleeve joined along a seam 11 to panels 3 and 5 near the shoulder areas 13 of shirt 1 and further including a collar band 15 secured about a head opening 17.

Figure 3:
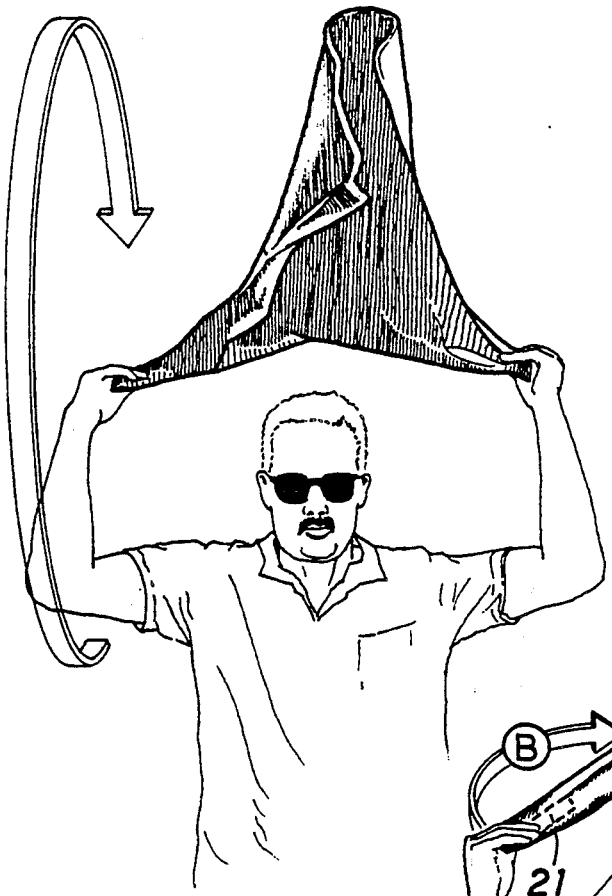
Figure 4:
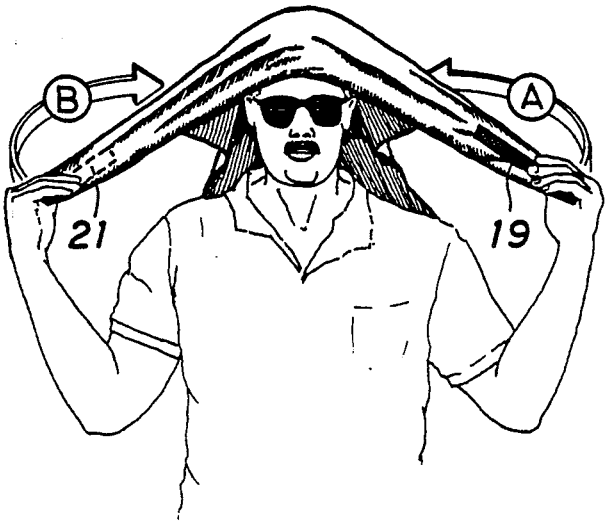

This invention comprises attaching first and second strips 19 and 21 respectively, of releasable, press-together bonding material to shirt 1 in spaced-apart relation to one panel such as panel 3 as shown, each said strip near panel-sleeve seam 11 and one set above the other as strip 21 is shown above strip 19 in FIG. 1. Thereafter, as shown in FIG. 2, the top of shirt 1 is folded downward, approximately one-half the depth of sleeves 9 to place first strip 19 on one side of shirt 1 and second strip 21 on the other side of shirt 1. As shown in FIGS. 3 and 4, torso-covering panels 3 and 5 are thereafter flipped up over the wearer's head, draped over the whole head and down over the back of the wearer's neck.

Figure 5:
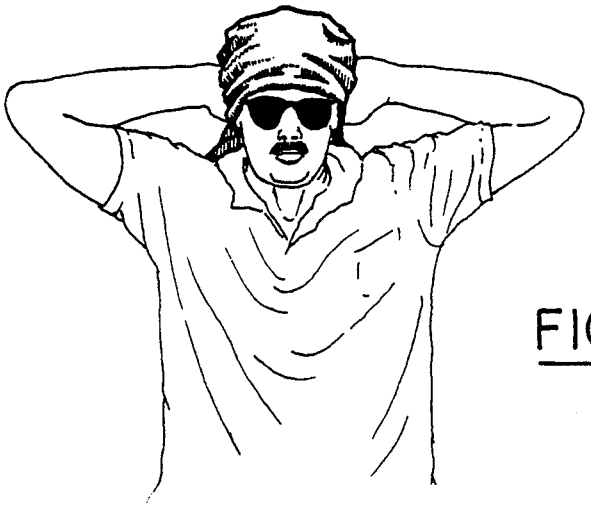
Figure 6:
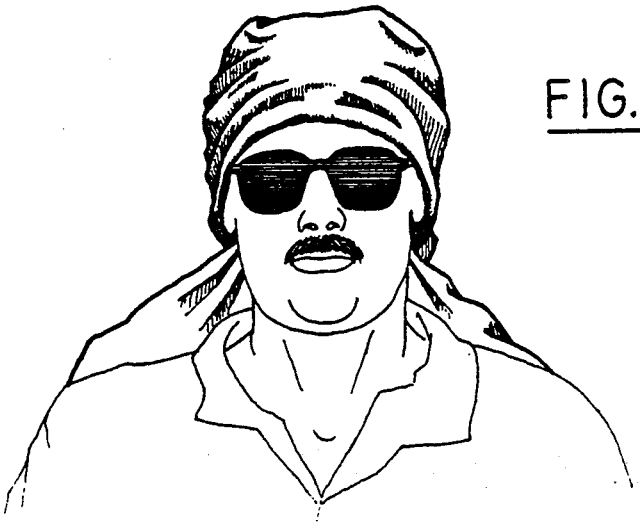
FIGS. 6 through 8 are front, side and rear views, respectively, of the shirt in the form of the final headdress; and, FIGS. 9 through 11 are illustrative views of various embodiments of the means of attaching the releasable, press-together bonding material strips to the shirt.
Figure 7:
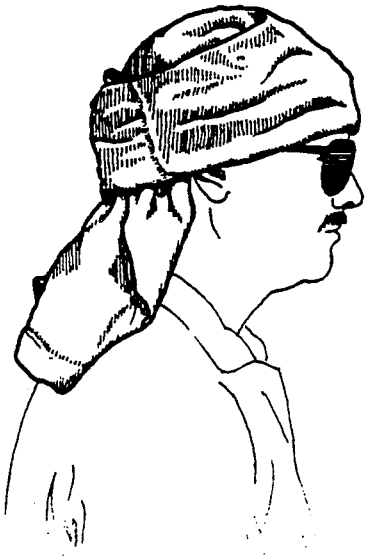
Figure 8:
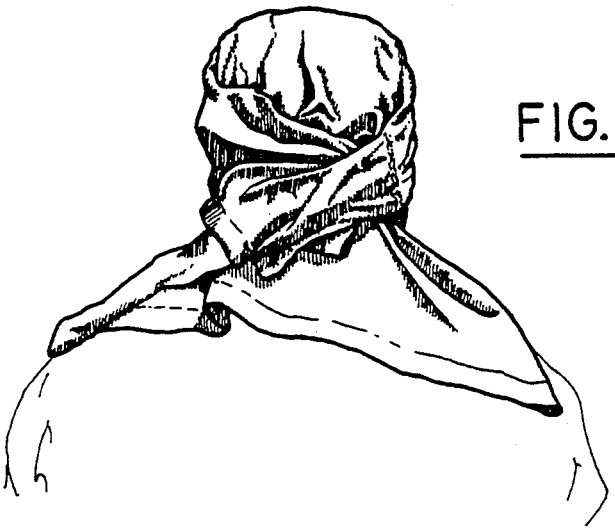

As shown in FIG. 5, sleeves 9 are thereafter wrapped rearward about the head over draped torso panels 3 and 5 and brought into overlapping contact along strips 19 and 21 by pressing said strips together, one on top of the other, to form the headdress As shown in FIGS. 6, 7 and 8, the headdress thereafter encompasses the entire upper portion of the head from above the eyebrows down to the lower part of the back of the head and around the sides of the head including the upper part of the ears, while the balance of the torso-covering panels 3 and 5 extend downward and outward to form a small cape covering the back of the wearer's neck as more clearly shown in FIG. 8.

This headdress is all the more novel and useful in that generally, when one takes their shirt off and wraps it about the head as shown in the figures, the torso is laid bare to the sun. Because we humans walk upright, our heads, necks and upper shoulders are the closest portions of our bodies to the sun and take the brunt of the exposure to harmful ultra-violet rays. The configuration of shirt 1 of this invention, especially the configuration shown in FIG. 8, shows the upper part of the head, the back of the neck and the upper part of the shoulders are fully covered by this novel headdress thereby providing maximum protection to the wearer's body while at the same time relieving them of the hot, encumbering shirt that is generally worn about the chest and upper torso.

Important is the fact that strips 19 and 21 may be attached as shown in FIG. 1 to rear panel 5 of shirt 1 as well as to front torso-covering panel 3 and the invention works equally well with either embodiment. Further, while the invention shown in its headdress form in FIGS. 6 through 8 are associated with a short sleeve shirt shown in FIG. 1 and known as a "T-shirt", this invention works equally well with long sleeve shirts since the joinder of first and second strips 19 and 21 retain sleeves 9 at the rear of the head out of contact with the sides of the head as would be the case where the sleeves were tied in a knot as noted in the aforedescribed prior art.

While Velcro (trademark) is the preferred releasable, press-together bonding material, other such materials are equally contemplated and included in this invention, including various configurations of snaps, hooks and grippers made in the form of strips that may equally be used in this invention and such modification is fully contemplated within the scope and spirit of this invention.

Figure 9:
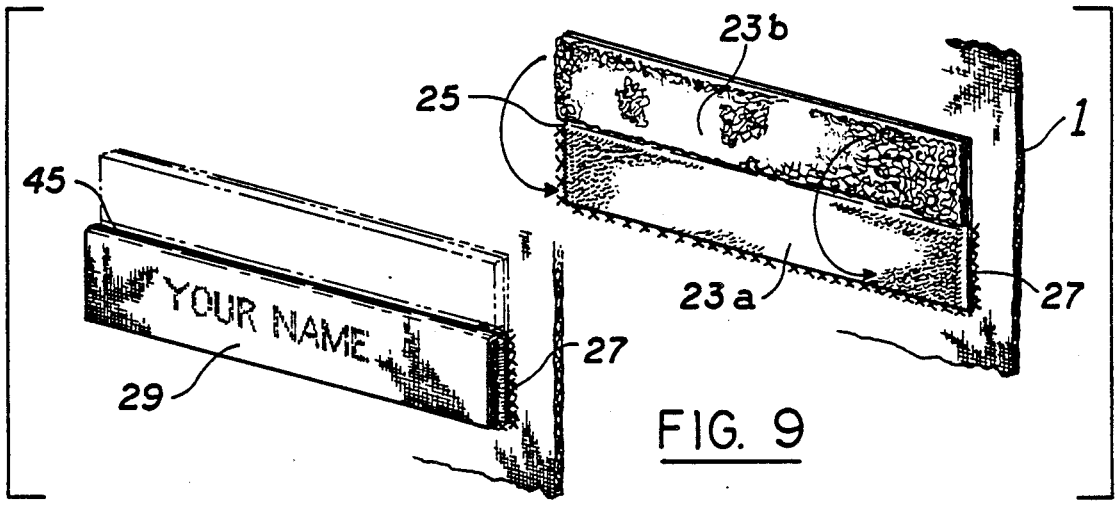
Figure 10:
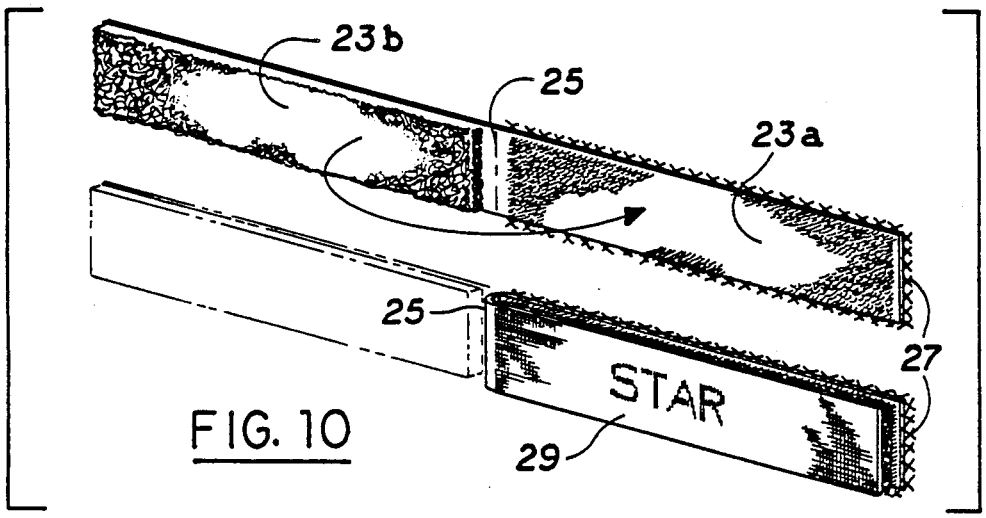
Figure 11:
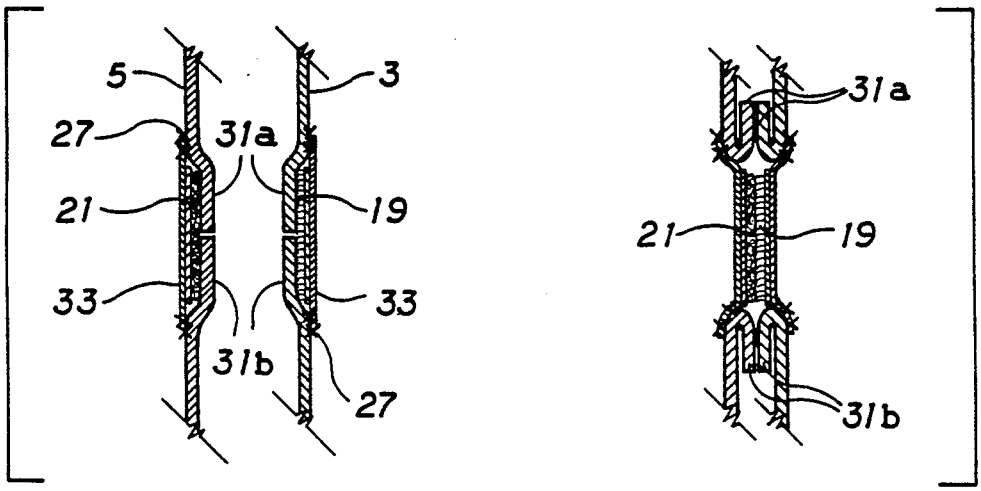

As shown in FIGS. 9, 10 and 11, first and second strips 19 and 21 may be made in alternative configurations and yet fully usable in this invention. As shown in FIGS. 9 and 10, strips 19 and/or 21 may be formed of a narrow strip **23*a* of a "male" releasable, press-together bonding material joined together at a fold line 25 to a narrow strip 23*b* of a "female" releasable, press-together bonding material. Strip 23*a*, in the configuration, is joined to shirt 1 such as by bonding or other known means as is shown as sewing by the small line of "x's" in the figures, along edges 27. When shirt 1 is being worn as a shirt and not as a headdress, strip 23*b* is folded over at fold line 25 onto strip 23*a* and the male and female portions of the bonding material interconnect to hold the strip in its folded configuration. This prevents the ingress of dirt, dust and lint onto the bonding surfaces of strips 23*a* and 23*b* so as to preserve their releasable, press-together bonding characteristics. In addition, the reverse side 29 of strip 23*b* may carry the wearer's name or advertisement or trademark indicia as shown in dotted outline in FIGS. 9 and 10**.

Another embodiment of the invention is shown in FIG. 11 where strips 19 or 21 are captured between a pair of flaps **31*a* and 31*b* formed in torso-covering panels 3 or 5 and held in that position by a separate backing strip 33 such that flaps 31*a* and 31*b* are folded over the bonding surface of the strips to hide it from view when shirt 1 is worn as a shirt. When shirt 1 is to be altered to the headdress form, the same folding of the top part of shirt 1 and flipping the panels over the head and down the back of the neck is accomplished and when sleeves 9 are folded over each other, flaps 31*a* and 31*b* on mating strips 19 and 21 are folded upward and downward, respectively, as shown to expose the full press-together, releasable bonding surfaces of said strips so they may be pressed together into interlocking configuration to form the headdress. Further, strips 23*a* and 23*b*** can be die cut in unique shapes for a dual use as decorative strips and press-together materials.

This invention may be used on a wide variety of knit shirts that form the general category of pull-over shirts such as T-shirts. When washing said shirt, it is advisable to place strips 19 and 21 in bonding relationship so that lint and other foreign material does not invade the bonding surfaces of said strips that would decrease the bonding ability of said strips after washing is completed. Strips 19 and 21 may also be die-cut into various decorative shapes and used in those forms with or without the various overlays heretofore described.

What is claimed is:

1. In a shirt of the type having a front side and a back side and comprising first and second shoulder and torso-covering panels joined together at seams formed along their respective side and top edges, a pair of spaced-apart arm holes formed in said seams adjacent the shoulder areas, including a pair of sleeves attached thereabout and extending outward therefrom and having a respective front side and back side corresponding to the front side and back side of said shirt and a head opening formed in said top seam, the improvement of rendering said shirt convertible to a headdress for covering the head and the back of the neck, comprising first and second strips of releasable, press-together bonding material, each attached to a different sleeve near said panel-sleeve seam, said strips being attached on the same side of said shirt, said strips arranged one above the other so that when the upper portion of said shirt is folded away and downward from said strips a distance of about one half the depth of said sleeves, said strips become positioned on opposite sides of the folded shirt, so that when said torso-covering panels are draped over the wearer's head and down over the rear of the wearer's neck, said folded sleeves may be wrapped rearward about the head and brought into overlapping contact at the back of the head along said strips to form the headdress.

2. The improvement of claim 1 wherein said strips are attached to the front side of said shirt.

3. The improvement of claim 1 wherein said strips are attached to the back side of said shirt.

4. The improvement of claim 1 wherein said sleeves are short sleeves and said shirt is a T-shirt.

5. The improvement of claim 1 wherein said strips are Velcro (trademark).

6. The improvement of claim 1 wherein said sleeves are short, said shirt is a T-shirt and said strips are Velcro.

7. The improvement of claim 1 wherein said first and second strips each comprise one part of male releasable, press-together bonding material and another part of female releasable, press-together bonding material attached together in a mirror image arrangement, only one of the parts of the two attached together being affixed to said shirt for fold-together interattachment of said parts during periods when said shirt is not used as a headdress and where said interattached parts are parted for press-together bonding of said first and seconds strips to form the headdress.

8. The improvement of claim 1 wherein said first and second strips are each recessed inside at least one flap each formed in a different sleeve, each flap arranged to be folded away from said bonding material when said strips are to be pressed together to form said headdress.

9. A convertible article of clothing including front and back fabric panels forming respective opposing front and back sides of said article covering the upper torso and shoulders in the manner of a T-shirt, joined together along seams formed along their respective side and top edges, and further including a pair of sleeves, said sleeves attached at said seams near the areas covering said shoulders and extending in opposing directions lateral to said panels, first and second strips of releasable, press-together bonding material each attached to a different sleeve and on one side of said shirt near a respective seam and set one above the other wherein, when the upper portion of said shirt is folded away and downward from said strips a distance of about one-half the depth of said sleeves, said strips become positioned on opposing sides of the folded shirt, so that when said torso-covering panels are draped over the wearer's head and down over the rear of the wearer's neck, said folded sleeves maya be wrapped rearward about the head and brought into overlapping contact at the back of the head along said strips to form the headdress.

10. The improvement of claim 9 wherein said strips are attached to the front side of said shirt.

11. The improvement of claim 9 wherein said strips are attached to the back side of said shirt.

12. The improvement of claim 9 wherein said sleeves are short sleeves and said shirt is a T-shirt.

13. The improvement of claim 9 wherein said strips are Velcro (trademark).

14. The improvement of claim 9 wherein said sleeves are short, said shirt is a T-shirt and said strips are Velcro.

15. The improvement of claim 9 wherein said first and second strips each comprise one part of male releasable, press-together bonding material and another part of female releasable, press-together bonding material attached together in a mirror image arrangement, only one of the parts of the two attached together being affixed to said shirt for fold-together interattachment of said parts during periods when said shirt is not used as a headdress and where said interattached parts are parted for press-together bonding of said first and second strips to form the headdress.

16. The improvement of claim 9 wherein said first and second strips are each recessed inside at least one flap each formed in a different sleeve, each flap arranged to be folded away from said bonding material when said strips are to be pressed together to form said headdress.

* * * * *